United States Patent [19]

Mountain

[11] 4,079,915

[45] Mar. 21, 1978

[54] HYDRO-POWER JACK

[75] Inventor: Donald Clifton Mountain, 2812 King Rd., N. Kingsville, Ohio 44068

[73] Assignee: Donald C. Mountain, N. Kingsville, Ohio

[21] Appl. No.: 823,081

[22] Filed: Aug. 10, 1977

[51] Int. Cl.[2] ..... B66F 3/24

[52] U.S. Cl. ..... 254/93 HP

[58] Field of Search ..... 254/93 HP; 4/185 L

[56] References Cited

U.S. PATENT DOCUMENTS

| | | | |
|---|---|---|---|
| 2,380,152 | 7/1945 | David | 254/93 HP |
| 2,609,177 | 9/1952 | Hughes | 254/93 HP |
| 2,817,096 | 12/1957 | Roth | 4/185 L |

*Primary Examiner*—Robert C. Watson

[57] ABSTRACT

This invention relates to a hydraulic jack that is comprised of a cloth protected inflatable bladder surrounded by a structure that contains and directs the force and motion of the bladder in one direction. The bladder is inflated and pressurized by tap water that is fed to it by a garden hose. This hydraulic jack is unique in that it uses a garden hose and tap water to connect and power it, in that it uses a continuous bladder to make it inherently fluid tight, in that it is of simple enough construction as to be relatively inexpensive to produce and easy to maintain, in that it is for operating purposes, massive enough in volume and section to produce ample strength, and ample stability in load balance.

13 Claims, 5 Drawing Figures

HYDRO-POWER JACK

DRAWING DESCRIPTION

FIG. 5 also shows a detail of head center hole.

MECHANICAL CONSTRUCTION

Figures 1, 2:
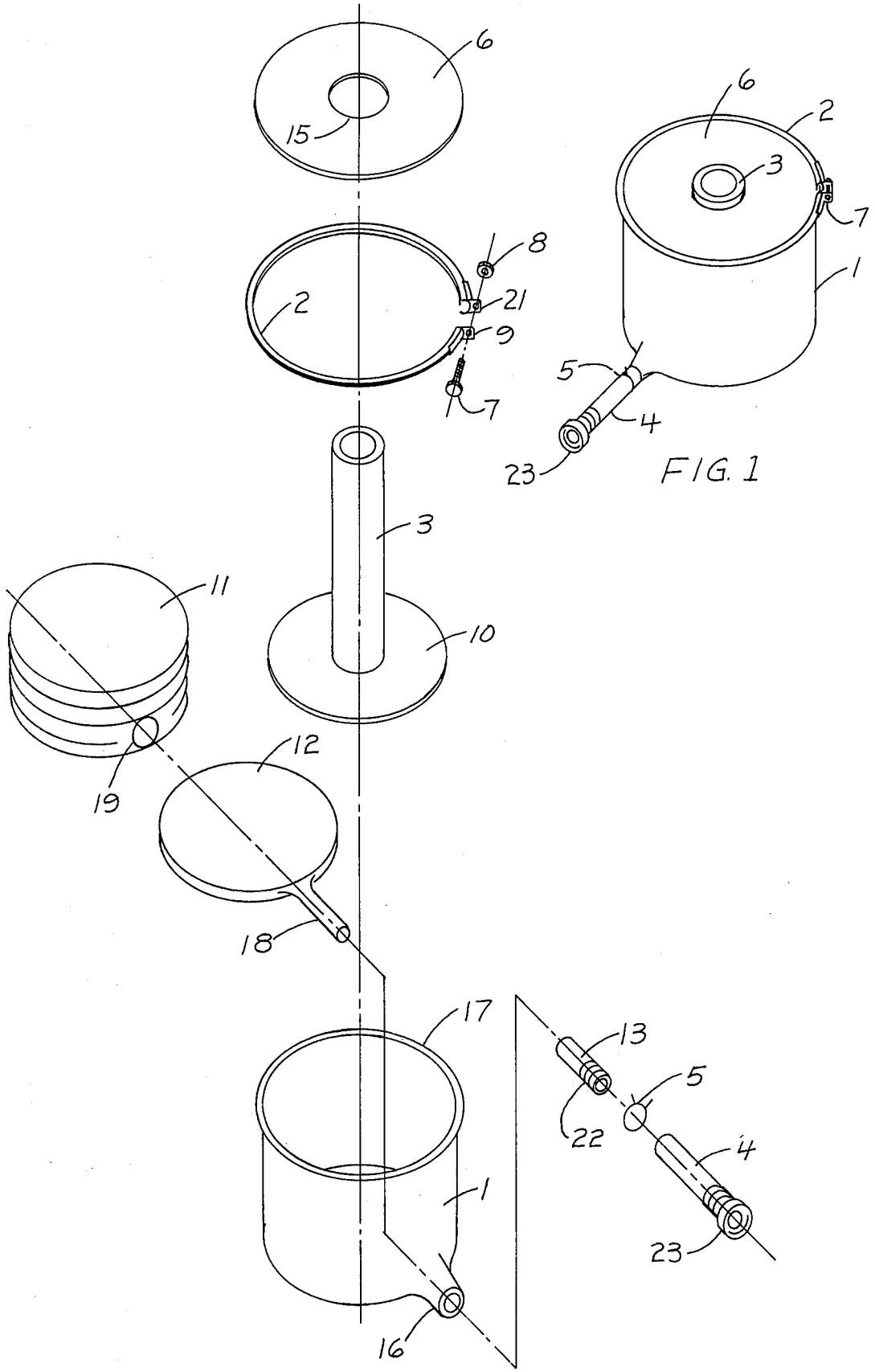
FIG. 1 illustrates a complete assembly of the jack as if it where ready for use.
FIG. 2 illustrates the jack and all its parts as if it where taken apart in logical order.
Figure 3:
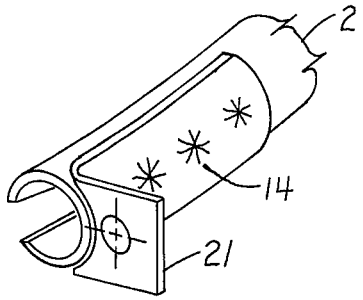
FIG. 3 is a detail of the end connection tab of the flange clamping ring.
Figure 4:
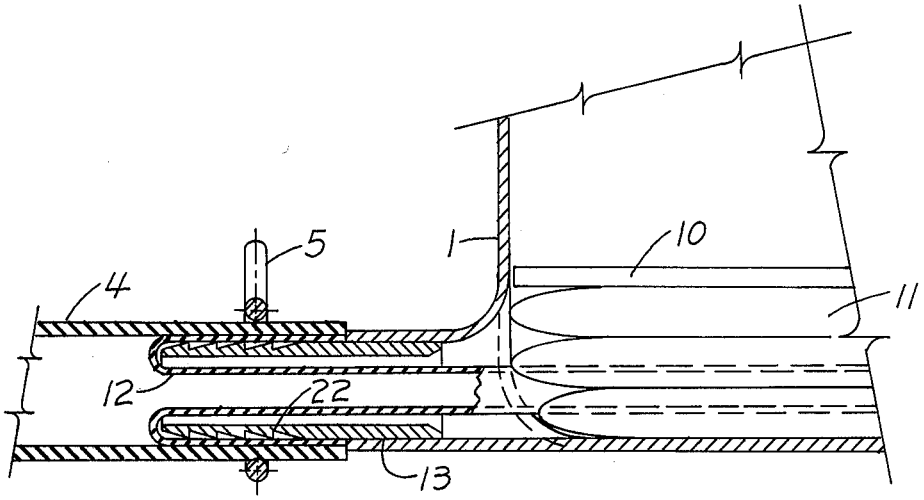
FIG. 4 is a detail of the connection of the tap water supply to the jack body can.
Figure 5:
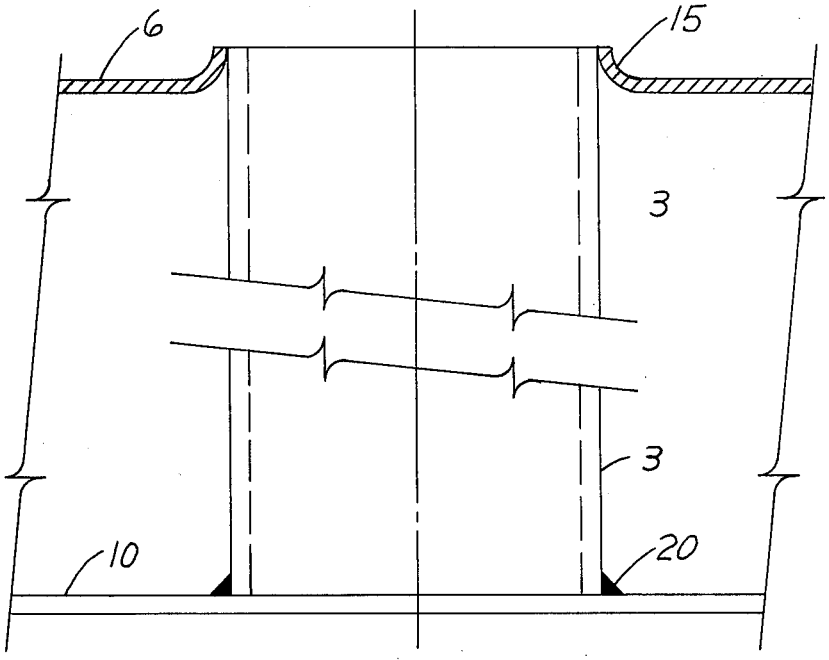
FIG. 5 is a detail of the connection of the piston plate and the hollow shaft.

The body of the jack is thin walled cylindrical can 1 FIGS. 1 & 2 which has a formed inlet nozzle 16 near the closed bottom and a formed flange 17 around the top opening. The said flange 17 connects the body 1 to the lid plate 6 FIGS. 1 & 2 by an open clamping ring 2 that is in the form of a "C" or bracket when looked upon in section. The mouth of the "C" section is pulled over the periphery of the lid plate and body flange by a clamp nut and bolt 8,7 FIG. 2 which extends thru clamp tabs 9,21 FIGS. 2 & 3 that are attached to the clamping ring 2 with tab connectors 14 (shown as spot welds). The lid plate has a hole in its center 15 which is flared outward to clear shaft connection 20 FIGS. 2 & 5 and allows the hollow shaft 3 to move up and down thru it. The said shaft 3 is connected to the center of piston plate 10 assembled inside of jack body 1 thru connection 20 (shown as a fillet weld- all around). The piston plate sets on an inflatable cloth bag 11 FIGS. 2 & 4 which has an impervious flexible, stretchable, inner bladder 12 FIGS. 2 & 4 like a heavy balloon. The inner bladder has an integral tube inlet 18 which extends out thru the bag outlet 19 FIG. 2 thru the nozzle 16 and thru and back over the spiggot piece 13. The said spiggot piece will be held into the nozzle 16 FIG. 4 by a shrink or force fit. The hose piece 4 FIGS. 2 & 4 will fit over the bladder tube covered spigot 13 FIG. 4 and will be held in place by the spiggot ferrules 21 and hose clamp 5. The hose piece 4 is terminated with a female hose fitting 23 that is compatable with and connectable to any standard garden hose.

OPERATION

Tap water flows into the inner bladder 18 FIG. 2 thru hose piece 4. The said bladder will expand and inflate due to the water pressure and lift the piston plate 10 and hollow shaft 3 which in turn will apply force to any load setting on top of them. The inner bladder 18 is restrained from penetrating the gap between the piston plate 10 FIG. 4 and the jack body 1 by the cloth bag 11 which also protects the bladder.

I claim:

1. A jack that has as a body a thin walled cylindrical can herein referred to as the jack body which has an open top and closed bottom and formed around the top a body flange ring and formed on the side of the can near the bottom a body nozzle that is itself fitted around a spiggot that has ferrules on the outboard end which has folded back over it an inlet to a bladder herein called the bladder tube that is along with the spiggot covered by a hose piece that is held to the bladder tube inlet and the ferrules of the said spiggot with a hose clamp which fits over one end of the hose piece that is terminated at the other end with a hose fitting that connects to a supply duct which allows fluid to enter the bladder tube inlet, and the bladder, which is surrounded and protected by a cloth bag that is in turn surrounded by the jack body that contains the bladder and directs its force against and imparts motion to a piston plate that is attached by a shaft connection in its center to a hollow shaft that protrudes from the interior of the jack thru a head opening in the center of the lid plate which is attached to the jack body by a clamping ring that is pulled together by a clamping nut and bolt that extends thru clamp tabs that are attached to the clamping ring by a tab connection which draws the clamping ring tight around the formed body flange at the open top of the jack body and the lid plate.

2. The jack of claim 1 in which the supply duct is common garden hose and the powering fluid is home tap water.

3. The jack of claim 1 in which the fluid is hermetically sealed into the cylindrical jack body by an impervious, flexible, stretchable, inner bladder forming a continuous seal around the pressurizing fluid.

4. The jack of claim 1 in which the inner bladder is protected by a cloth bag.

5. The jack of claim 4 in which the inner bladder and cloth bag are replaced by a single bladder reinforced with flexible cord.

6. The jack of claim 1 in which the thrusting shaft is hollow and the connection between the said shaft and the piston plate is a weld.

7. The jack of claim 1 in which the body flange and body nozzle are formed into the material of the jack body as one integral piece.

8. The jack of claim 1 in which the lid plate and the jack body are attached one to the other by a "C" or bracket sectioned clamping ring that is pulled tight by one bolt and nut.

9. The jack of claim 1 in which the bladder tube, and hose piece are secured to the spiggot simultaneously by one clamp.

10. The jack of claim 6 in which the center hole of the lid plate is flared to clear the welded connection between the piston plate and the hollow shaft.

11. The jack of claim 1 in which the spiggot is ferruled and is held into the jack body nozzle by a force or shrink fit.

12. The jack of claim 8 in which the clamping ring end connections, herein referred to as clamp tabs, are of a one piece thin walled section bent and formed and spot or seam welded to the clamping ring.

13. The jack of claim 1 in which the hose clamp is a partially lapping single coil of spring wire with a clamping diameter that can be increased by squeezing the out bent ends of the coiled wire together.

* * * * *